US008843034B2

(12) United States Patent
Yamane et al.

(10) Patent No.: US 8,843,034 B2
(45) Date of Patent: Sep. 23, 2014

(54) TONER CONTAINER, TONER CONTAINER FRAME, AND IMAGE FORMING APPARATUS INCORPORATING SAME

(75) Inventors: Masayuki Yamane, Kanagawa (JP); Tadashi Hayakawa, Kanagawa (JP); Kunihiro Ohyama, Tokyo (JP); Takeshi Uchitani, Kanagawa (JP); Yasufumi Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 201 days.

(21) Appl. No.: 13/467,413

(22) Filed: May 9, 2012

(65) Prior Publication Data

US 2012/0308242 A1 Dec. 6, 2012

(30) Foreign Application Priority Data

Jun. 3, 2011 (JP) ..... 2011-124947

(51) Int. Cl.
*G03G 15/08* (2006.01)

(52) U.S. Cl.
USPC ..... 399/262

(58) Field of Classification Search
USPC ..... 399/262, 263
See application file for complete search history.

(56) References Cited

U.S. PATENT DOCUMENTS

| | | | | |
|---|---|---|---|---|
| 7,574,162 | B2 | 8/2009 | Yamane | |
| 7,835,675 | B2 | 11/2010 | Taguchi et al. | |
| 7,853,184 | B2 * | 12/2010 | Taguchi et al. | 399/262 |
| 8,050,597 | B2 | 11/2011 | Yoshizawa et al. | |
| 2006/0034642 | A1 | 2/2006 | Taguchi et al. | |
| 2009/0317140 | A1 | 12/2009 | Yoshida et al. | |
| 2010/0119264 | A1 | 5/2010 | Yamaguchi et al. | |
| 2010/0189470 | A1 | 7/2010 | Yoshizawa et al. | |
| 2010/0225716 | A1 | 9/2010 | Hayakawa et al. | |
| 2011/0020017 | A1 | 1/2011 | Takahashi | |

(Continued)

FOREIGN PATENT DOCUMENTS

| | | | |
|---|---|---|---|
| CN | 201322846 | Y | 10/2009 |
| CN | 102012655 | A | 4/2011 |

(Continued)

OTHER PUBLICATIONS

Combined Office Action and Search Report issued Jan. 6, 2014 in Chinese Patent Application No. 201210180879.3 (with English Translation of Category of Cited Documents).

(Continued)

*Primary Examiner* — Sandra Brase
(74) *Attorney, Agent, or Firm* — Oblon, Spivak, McClelland, Maier & Neustadt, L.L.P.

(57) ABSTRACT

A toner container is removably installable in an image forming apparatus having a communication portion and a positioning hole. The toner container includes an electronic data storage device disposed on a surface of the toner container, to communicate with the communication portion in the image forming apparatus, the electronic data storage device having an engaged hole; and a positioning projection, formed in the surface of the toner container, to engage the engaged hole of the electronic data storage device and the positioning hole in the image forming apparatus. The positioning projection inserts into the positioning hole in the image forming apparatus with the positioning projection engaging the engaged hole in the electronic data storage device to determine an installation position of the toner container relative to the image forming apparatus and set the electronic data storage device relative to the communication portion in the image forming apparatus.

15 Claims, 6 Drawing Sheets

(56) References Cited

U.S. PATENT DOCUMENTS

| | | | |
|---|---|---|---|
| 2011/0064478 | A1 | 3/2011 | Yamaguchi et al. |
| 2011/0176820 | A1 | 7/2011 | Kadota et al. |
| 2012/0045244 | A1 | 2/2012 | Komatsu et al. |

FOREIGN PATENT DOCUMENTS

| | | | |
|---|---|---|---|
| JP | 10-49032 | | 2/1998 |
| JP | 2003-255697 | | 9/2003 |
| JP | 2005-266298 | A | 9/2005 |
| JP | 2006-178146 | | 7/2006 |
| JP | 2009-69417 | | 4/2009 |
| JP | 2009-186554 | | 8/2009 |
| WO | WO 2011/155642 | A1 | 12/2011 |

OTHER PUBLICATIONS

U.S. Appl. No. 13/291,497, filed Nov. 8, 2011, Yusufumi, Takahashi.
U.S. Appl. No. 13/448,987, filed Apr. 17, 2012, Yusufumi Takahashi, et al.
U.S. Appl. No. 13/355,020, filed Jan. 20, 2012, Yoshihiro Fujiwara, et al.
U.S. Appl. No. 13/413,733, filed Mar. 7, 2012, Unknown.
U.S. Appl. No. 13/413,116, filed Mar. 6, 2012, Takeshi Uchitani, et al.
U.S. Appl. No. 13/304,476, filed Nov. 25, 2011, Masayuki Yamane, et al.

* cited by examiner

COMPARATIVE EXAMPLE

TONER CONTAINER, TONER CONTAINER FRAME, AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-124947, filed on Jun. 3, 2011, in the Japanese Patent Office, the entire disclosure of which is hereby incorporated by reference herein.

FIELD OF THE INVENTION

1. Technical Field

The present invention generally relates to a toner container and an image forming apparatus in which the toner container is installed to replenish toner consumed during image formation.

2. Description of the Related Art

Electrophotographic image forming apparatuses such as copiers, printers, facsimile machines, plotters, multi-function machines, or the like typically include cylindrical toner containers (bottles) that are removably installable in the image forming apparatuses.

Thus, for example, in JP-2007-178969-A describes a toner container (toner cartridge) that is removably installable in the image forming apparatus and which consists mainly of a container body (bottle body) and a cap (handle member). A continuous inwardly protruding spiral protrudes inward from an inner surface of the container body that, as the container rotates, transports the toner contained in the container body to an opening in one end of the container body. The cap, which covers the opening in the container body, is held stationary; i.e., it does not rotate with the rotation of the container body. The toner discharged from the opening in the container body is discharged from the toner container altogether via a toner discharge outlet formed in the cap. Then, the toner discharged from the toner discharge outlet in the cap is supplied to a development device, where it is used to develop an electrostatic latent image into a visible toner image.

In the above-configured toner container, electronic data storage devices (electronic elements) to store data relating to the toner contained in the toner container are fixed on or set on the cap by thermal caulking or press fitting. In a state in which the toner container is installed in the image forming apparatus, the electronic data storage device in the toner container communicates with a communication portion (communication circuit) in the image forming apparatus to transmit the data stored in the electronic data storage device to the image forming apparatus side, while the data transmitted from the image forming apparatus is newly stored in the electronic data storage device.

However, the position of the electronic data storage device in the toner container may be deviated from the position of the communication portion of the image forming apparatus, thereby causing communication failure.

SUMMARY

In one aspect of this disclosure, there is provided a toner container, removably installable in an image forming apparatus including a communication portion and having a positioning hole. The toner container includes an electronic data storage device and a positioning projection. The electronic data storage device is disposed on a surface of the toner container, to communicate with the communication portion in the image forming apparatus. The electronic data storage device has an engaged hole. The positioning projection is formed in the surface of the toner container, to engage the engaged hole of the electronic data storage device and the positioning hole in the image forming apparatus. The positioning projection of the toner container inserts into the positioning hole in the image forming apparatus in a state in which the positioning projection engages the engaged hole in the electronic data storage device to determine an installation position of the toner container relative to the image forming apparatus and set the electronic data storage device relative to the communication portion in the image forming apparatus.

In another aspect of this disclosure, there is provided a toner container frame in which the toner container is removably installable. The toner container frame includes a communication portion and a positioning portion. The communication portion is formed in an inner wall of the toner container frame, to communicate with the electronic data storage device in the toner container in a state in which the surface of the toner container faces the inner wall of the toner container frame. The positioning portion is provided in the inner wall of the toner container frame, having a positioning hole to engage the positioning projection of the toner container. The positioning projection of the toner container inserts into the positioning hole of the positioning portion in the toner container frame in a state in which the positioning projection engages the engaged hole in the electronic data storage device to determine an installation position of the toner container relative to the image forming apparatus and set the electronic data storage device relative to the communication portion in the toner container frame.

In another aspect of this disclosure, there is provided an image forming apparatus including the toner container frame that is provided in a main body of the image forming apparatus and at least one toner container that is removably installable in the toner container frame.

BRIEF DESCRIPTION OF THE DRAWINGS

The aforementioned and other aspects, features, and advantages will be better understood by reference to the following detailed description when considered in connection with the accompanying drawings, wherein.

DETAILED DESCRIPTION OF PREFERRED EMBODIMENTS

Figure 1:
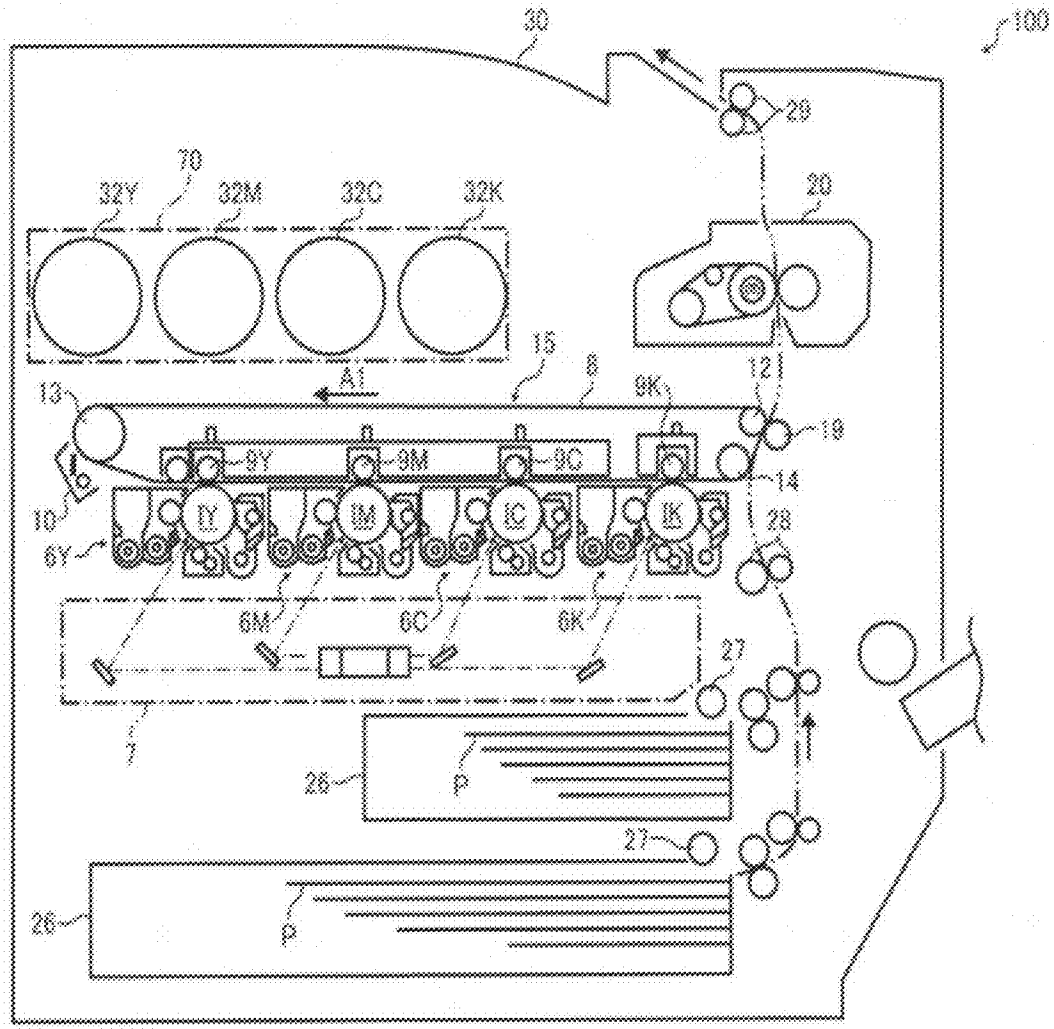
FIG. 1 is a schematic diagram illustrating an image forming apparatus according to the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 through 6 and 8, image forming apparatus according to illustrative embodiments are described. It is to be noted that although the image forming apparatus of the present embodiment is described as a printer, the image forming apparatus of the present invention is not limited thereto. In addition, it is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

(Configuration of Image Forming Apparatus)

An illustrative embodiment is described below with reference to FIGS. 1 to 6. Initially, a configuration and operation of an image forming apparatus according to the present embodiment is described.

FIG. 1 is a schematic diagram illustrating an image forming apparatus 100 according to the present disclosure entirely. As shown in FIG. 1, a toner container frame 70 (toner container mount) is provided in an upper part of an apparatus body of the image forming apparatus 100, and four toner containers 32Y, 32M, 32C, and 32K respectively corresponding to yellow, magenta, cyan, and black are removably installed in the toner container frame 70 (also shown in FIGS. 3 through 6). An intermediate transfer unit 15 including an intermediate transfer belt 8 is provided beneath the toner container frame 70. Image forming units 6Y, 6M, 6C, and 6K (see FIG. 3) respectively corresponding to yellow, magenta, cyan, and black are arranged in parallel, facing the intermediate transfer belt 8. Toner supply devices 60Y, 60M, 60C, and 60K are provided beneath the toner containers 32Y, 32M, 32C, and 32K, respectively. Each toner supply device 60 supplies the toner contained in the corresponding toner container 32 to a development device 5 of the corresponding image forming unit 6.

Figure 2:
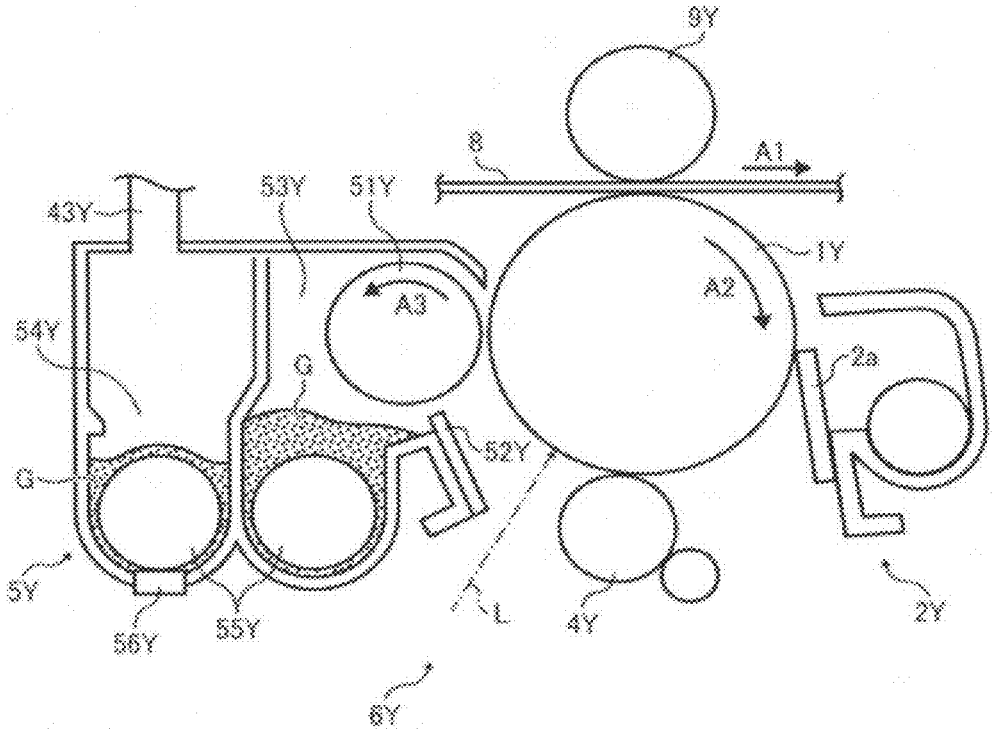
FIG. 2 is a schematic cross-sectional diagram illustrating the image forming unit included in the image forming apparatus shown in FIG. 1.

FIG. 2 is a schematic diagram illustrating the image forming unit 6Y. Referring to FIG. 2, the image forming unit 6Y for yellow includes a photoreceptor drum 1Y and further includes a charging member 4Y, the development device 5Y, a cleaning unit 2Y, a discharger, and the like provided around the photoreceptor drum 1Y. Image forming processes, namely, charging, exposure, development, transfer, and cleaning processes are performed on the photoreceptor drum 1Y, and thus a yellow toner image is formed on the photoreceptor drum 1Y.

It is to be noted that other image forming units 6M, 6C, and 6K have a similar configuration to that of the yellow image forming unit 6Y except the color of the toner used therein and form toner images of the respective colors. Thus, only the image forming unit 6Y is described below and a description of other image forming units 6M, 6C, and 6K is omitted.

Referring to FIG. 2, the photoreceptor drum 1Y is rotated clockwise in FIG. 2 as indicated by arrow A2 by a driving motor. A surface of the photoreceptor drum 1Y is charged uniformly at a position facing the charging member 4Y by the charging member 4Y (charging process). When the photoreceptor drum 1Y reaches a position to receive a laser beam L emitted from an exposure unit 7 (shown in FIG. 1), the photoreceptor drum 1Y is scanned with the laser beam L, and thus an electrostatic latent image for yellow is formed thereon (exposure process).

Then, the photoreceptor drum 1Y reaches a position facing the development device 5Y, where the latent image is developed with toner into a yellow toner image (development process). When the surface of the photoreceptor drum 1Y carrying the toner image reaches a position facing a primary-transfer bias roller 9Y via the intermediate transfer belt 8, the toner image is transferred therefrom onto the intermediate transfer belt 8 (primary-transfer process). After the primary-transfer process, a certain amount of toner tends to remain on the photoreceptor drum 1Y.

When the surface of the photoreceptor drum 1Y reaches a position facing the cleaning unit 2Y, a cleaning blade 2*a* of the cleaning unit 2Y mechanically collects any toner remaining on the photoreceptor drum 1Y (cleaning process). Subsequently, the discharger removes potentials remaining on the surface of the photoreceptor drum 1Y. Thus, a sequence of image forming processes performed on the photoreceptor drum 1Y is completed.

The above-described image forming processes are performed in the image forming units 6M, 6C, and 6K similarly to the yellow image forming unit 6Y. That is, the exposure unit 7 disposed above the image forming units 6 in FIG. 1 directs laser beams L according to image data onto the photoreceptor drums 1 in the respective image forming units 6. Specifically, the exposure unit 7 includes light sources to emit the laser beams L, multiple optical elements, and a polygon minor that is rotated by a motor. The exposure unit 7 directs the laser beams L to the respective photoreceptor drums 1 via the multiple optical elements while deflecting the laser beams L with the polygon mirror. Then, the toner images formed on the respective photoreceptor drums 1 through the development process are transferred therefrom and superimposed one on another on the intermediate transfer belt 8. Thus, a multicolor toner image is formed on the intermediate transfer belt 8.

Referring now to FIG. 1, the intermediate transfer unit 15 includes the intermediate transfer belt 8, the four primary-transfer bias rollers 9, a secondary-transfer backup roller 12, a cleaning backup roller 13, a tension roller 14, and a belt cleaning unit 10. The intermediate transfer belt 8 is supported by the multiple rollers and is rotated in the direction indicated by arrow A1 shown in FIG. 1 as one of the multiple rollers that serves as a driving roller rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are hereinafter referred to as primary-transfer nips. Each primary-transfer bias roller 9 receives a transfer bias whose polarity is opposite the polarity of the toner. While rotating in the direction indicated by the arrow A1 shown in FIG. 1, the intermediate transfer belt 8 sequentially passes through the primary transfer nips formed between the photoreceptor drums 1 and the corresponding primary-transfer bias rollers 9. Then, the single-color toner images are transferred from the respective photoreceptor drums 1 primarily and superimposed one on another on the intermediate transfer belt 8.

Then, the intermediate transfer belt 8 carrying the multicolor toner image reaches a position facing a secondary-transfer roller 19 disposed facing the secondary-transfer backup roller 12. The secondary-transfer backup roller 12 and the secondary-transfer roller 19 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the belt cleaning unit 10, any toner remaining on the intermediate transfer belt 8 is collected by the belt cleaning unit 10. Thus, a sequence of image forming processes performed on the intermediate transfer belt 8 is completed.

The sheet P is transported from a sheet feeder 26 provided in a lower portion of the image forming apparatus 100 to the secondary-transfer nip via a feed roller 27, and a pair of registration rollers 28. More specifically, the sheet feeder 26 contains multiple sheets P piled one on another. The feed roller 27 rotates counterclockwise in FIG. 1 to feed the sheet P on the top contained in the sheet feeder 26 toward a nip formed between the registration rollers 28.

The registration rollers 28 stop rotating temporarily, stopping the sheet P with a leading edge of the sheet P held in the nip therebetween. The registration rollers 28 resumes rotating to transport the sheet P to the secondary-transfer nip, time to coincide with the arrival of the multicolor toner image formed on the intermediate transfer belt 8. Thus, the multicolor toner image is recorded on the sheet P.

The recording medium P carrying the color toner image is sent to a fixing device 20. In the fixing device 20, a fixing belt and a pressing roller apply heat and pressure to the sheet P to fix the multicolor toner image on the sheet P. Subsequently, the sheet P is discharged by a pair of discharge rollers 29 outside the image forming apparatus 100 and stacked as an output image on a stack tray 30 formed on an upper side of the apparatus body. Thus, a sequence of image forming processes performed in the image forming apparatus 100 is completed.

Next, a configuration and operation of the development device 5Y is described in further detail below with reference to FIG. 2. The development device 5Y includes a development roller 51Y disposed facing the photoreceptor drum 1Y, a doctor blade 52Y disposed facing the development roller 51Y, two conveyance screws 55Y respectively disposed in developer containing compartments 53Y and 54Y, and a concentration detector 56Y to detect concentration of toner in developer G. A casing of the development device 5Y is divided, at least partially, into the developer containing compartments 53Y and 54Y. The development roller 51Y includes a magnet roller or multiple magnets fixed in position relative to the casing of the development device 5Y, a sleeve that rotates around the magnet roller, and the like. The developer containing compartments 53Y and 54Y contain two-component developer G consisting essentially of carrier (carrier particles) and toner (toner particles). An opening is formed on an upper side of the developer containing compartment 54Y, and the developer containing compartment 54Y is connected via the opening to a toner supply tube (toner transport path) 43Y through which toner is supplied from the toner container 32Y.

The development device 5Y configured as described above operates as follows. The development sleeve of the development roller 51Y rotates in the direction indicated by arrow A3 shown in FIG. 2. The developer G carried on the development roller 51Y by the magnetic field generated by the magnets is transported in the circumferential direction of the development roller 51Y as the development sleeve rotates.

The ratio of the toner to the carrier (the concentration of toner) in the developer G contained in the development device 5Y is adjusted within a predetermined range. More specifically, the toner supply device 60Y (shown in FIG. 3) supplies toner from the toner container 32Y to the developer containing compartment 54Y according to the consumption of toner in the development device 5Y. The configuration and operation of the toner supply device 60 are described in further detail later.

The toner supplied to the developer containing compartment 54Y is mixed with the developer G therein, and the developer G is circulated in the direction perpendicular to the surface of the paper on which FIG. 2 is drawn between the two developer containing compartments 53Y and 54Y while agitated by the developer conveying screws 55Y. While the developer G is thus agitated, toner particles in the developer G are charged with friction with carrier particles and adsorbed to the carrier particles. Then, the toner particles are carried on the developing roller 51Y together with the carrier particles by a magnetic force generated on the developing roller 51Y.

The developer G carried on the development roller 51Y is transported in the direction indicated by arrow A3 in FIG. 2 to the doctor blade 52Y. The amount of the developer G on the development roller 51Y is adjusted to a suitable amount by the doctor blade 52Y, after which, the developer G is carried to the development range facing the photoreceptor drum 1Y. Then, the toner in the developer G adheres to the latent image formed on the photoreceptor drum 1Y due to the effect of the magnetic field generated in the development range. As the sleeve rotates, the developer G remaining on the developing roller 51Y reaches an upper part in the developer containing compartment 53Y and then drops from the developing roller 51Y.

Figure 3:
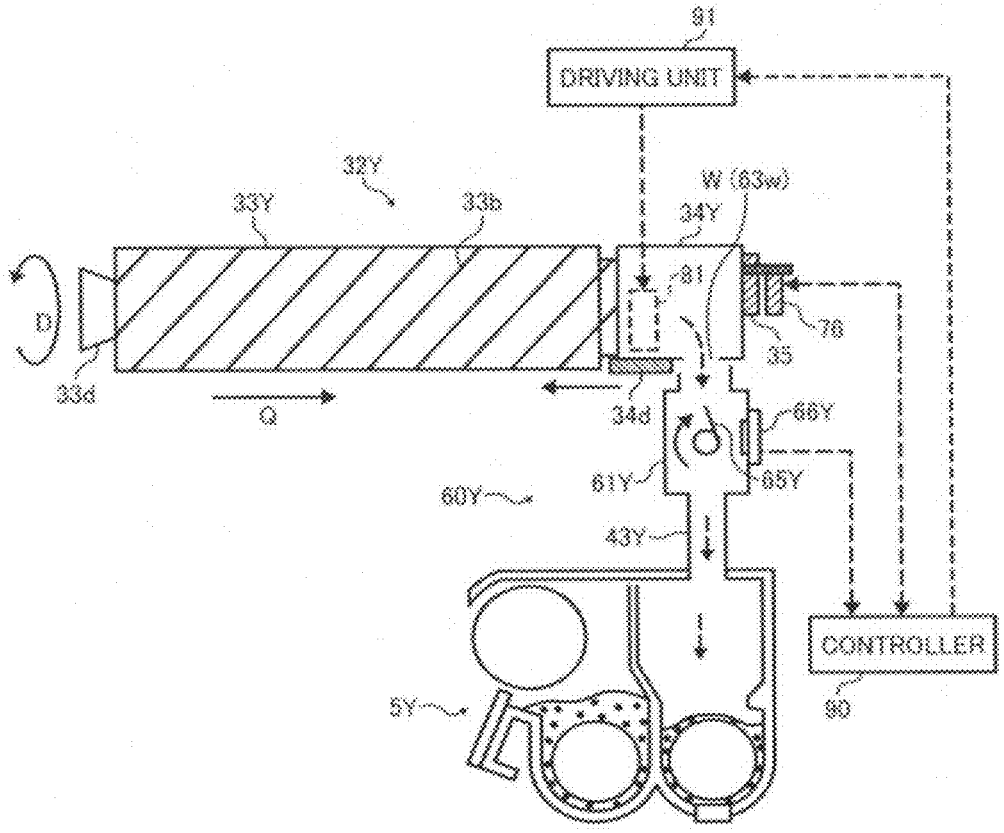
FIG. 3 is a schematic diagram illustrating a toner supply device and a toner container connected thereto included in the image forming apparatus shown in FIG. 1.
Figure 4:
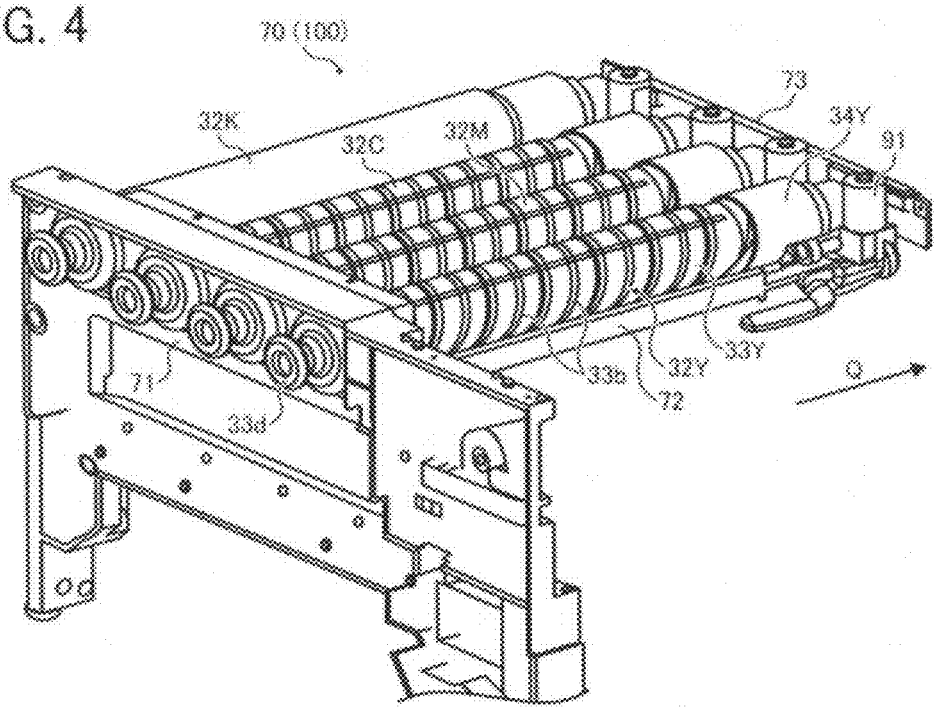
FIG. 4 is a perspective view of a toner container frame included in the image forming apparatus shown in FIG. 1, in which the toner container shown in FIG. 3 is set.

Referring to FIGS. 3 and 4, the respective color toners contained in the toner containers 32Y, 32M, 32C, and 32K mounted in the toner container frame 70 of the image forming apparatus 100 are supplied to the corresponding development devices 5Y, 5M, 5C, and 5K by the corresponding toner supply devices 60Y, 60M, 60C, and 60K according to the amount of the toner consumed. It is to be noted that the structure of the toner supply devices 60Y, 60M, 60C, and 60K are similar, and the structure of the toner containers 32Y, 32M, 32C, and 32K are similar except the color of toner used. Therefore, only the structures for yellow are described below, omitting descriptions of other colors. In addition, FIG. 3 shows the toner container 32Y for yellow, simplified.

Referring to FIG. 3, the toner container 32Y is a substantially cylindrical toner bottle and includes a container body (bottle body) 33Y formed integrally with a gear 33*c* (shown in FIG. 5) and a cap 34Y. The cap 34Y is held stationary by the toner container frame 70 so as not to rotate. Further, a toner outlet W (toner discharge outlet) is formed on a lower side of the cap 34Y, and the cap 34Y further includes a shutter 34*d* to open and close the toner outlet W. It is to be noted that, in the description below, the terms "longitudinal direction" and "short side direction" mean those of the toner containers 32 unless otherwise specified, and the term "installation direction" means the direction in which the toner containers 32 are installed into the image forming apparatus 100 unless otherwise specified.

As shown in FIG. 4, when the toner container 32Y is installed in the toner container frame 70 in a direction indicated by arrow Q in FIG. 4 (hereinafter "insertion direction" or "installation direction"), the shutter 34*d* (shown in FIG. 3) of the toner container 32Y is moved in conjunction with this installation, and the toner outlet W (shown in FIG. 3) of the toner container 32Y is opened, thereby aligning the toner outlet W of the toner container 32Y with a toner supply opening 63*w* of the toner supply device 60. Accordingly, the toner contained in the toner container 32Y is discharged through the toner outlet W and the toner supply opening 63*w* to a toner tank 61Y of the toner supply device 60Y.

The container body 33Y is held by the toner container frame 70 rotatably relative to the cap 34Y in a direction indicated by arrow D shown in FIG. 3 by a driving unit 91 that includes a driving motor (not shown), a driving gear 81, and the like. A continuous inwardly projecting spiral 33*b* protruding inward is formed in an inner surface of the container body 33Y. With this configuration, as the container body 33Y rotates, the toner contained in the container body 33Y is transported in a longitudinal direction of the toner container 32Y (from the left to the right in FIG. 3) and is discharged from the toner outlet W. That is, the driving unit 91 rotates the container body 33Y of the toner container 32Y as required, thus supplying the toner to the toner tank 61Y of the toner supply device 60. It is to be noted that, when the service lives of the toner containers 32Y, 32M, 32C, and 32K have expired, that is, when almost all toner in the toner container 32 is consumed, the old one is replaced with a new one.

Referring to FIGS. 3 and 4, it can be seen that the toner supply device 60Y includes the toner tank 61, a toner conveyance screw (not illustrated), the toner supply path (not illustrated), a toner agitator 65Y, and a toner detector 66Y. The toner detector 66Y can communicate with a controller 90 of the image forming apparatus 100, which controls the driving unit 91. It is to be noted that, in FIG. 3, reference character 33*d* represents a handle part of the toner container 32Y. The toner tank 61Y is positioned beneath the toner outlet W of the toner container 32Y and stores the toner discharged therein through the toner outlet W as well as the toner supply opening 63*w* from the toner container 32Y. A bottom portion of the toner tank 61Y is connected to an upstream side of the toner conveyance screw in a direction in which the developer G is transported (hereinafter "developer conveyance direction").

The toner detector 66Y is disposed on a side wall of the toner tank 61Y at a predetermined height from the bottom of the toner tank 61Y. The toner detector 66Y detects that the amount of the toner stored in the toner tank 61Y is reduced to or below a predetermined amount. For example, a piezoelectric sensor can be used as the toner detector 66Y. When the toner detector 66Y detects that the amount of the toner stored in the toner tank 61Y is less than the predetermined amount, the controller 90 can recognize it. Then, the controller 90 causes the driving unit 91 (including the driving gear 81) to rotate the container body 33Y of the toner container 32Y for a predetermined period, thereby supplying toner to the toner tank 61Y. If the toner detector 66Y continues to detect that the remaining toner amount is less than the predetermined amount even when this operation is repeated for a predetermined time period, the controller deems the toner container 32Y empty. Then, the controller 90 causes a display of the image forming apparatus to instruct users to replace the toner container 32Y.

The toner agitator 65Y is disposed in a center portion inside the toner tank 61Y adjacent to the toner detector 66Y for preventing the toner stored therein from being coagulated. The toner agitator 65Y includes a flexible member provided on a shaft and rotates clockwise in FIG. 3, thus stirring the toner in the toner tank 61Y. In addition, a tip of the flexible member of the toner agitator 65Y slidably contacts a detection surface of the toner detector 66Y periodically with rotation cycle of the toner agitator 65Y, thus preventing toner from adhering to the detection surface of the toner detector 66Y. Accordingly, a decrease in the detection accuracy can be prevented or restricted.

In FIG. 3, the toner supply tube 43Y extending in vertical direction is connected between the toner tank 61Y and the development device 5Y. Then, the toner thus conveyed in the toner tank 61Y drops under its own weight through the toner supply tube 43Y, and then is supplied to the developer containing compartment 54Y in the development device 5Y. Alternatively, the toner supply tube 43Y that extending different direction except the vertical direction may be connected between the toner tank 61Y and the development device 5Y. Yet alternatively, the toner discharged from the toner container 32Y may directly drop under its own weight to the development device 5Y. Yet alternatively, although the toner supply device 60 is not limited to the configuration through which the toner drops under its own weight, for example, the toner may be transported using the screw pump and air pump.

Further, referring to FIG. 4, the toner container frame 70 includes a cap holder 73, provided in a downstream portion of the toner container frame 70 in a direction in which the toner containers 32 are inserted into the toner container frame 70, that holds the caps 34 of the respective toner containers 32, a bottle holder 72 that holds the container bodies 33 of the respective toner containers 32, and an insertion portion 71 having four insertion openings through which the four toner containers 32 are inserted into and removed from the toner container frame 70.

Referring again to FIG. 1, when a main body cover provided on the front side of the image forming apparatus 100 (on the front side of the paper on which FIG. 1 is drawn) open, the insertion portion 71 of the toner container frame 70 is exposed. The toner containers 32Y, 32M, 32C, and 32K are inserted and removed on the front side of the image forming apparatus 100 with the long axis of the toner containers 32Y, 32M, 32C, and 32K kept horizontal. Herein, a longitudinal length of the bottle holder 72 is almost equal to the longitudinal length of the container body 33Y. In addition, the cap holder 73 is provided at an end of the bottle holder 72 in its longitudinal direction (on the leading side of downstream side in the direction of insertion), and the insertion portion 71 is provided at the other end (on the upstream side) of the bottle holder 72 in that direction. Therefore, when the toner container 32Y is inserted into the toner container frame 70, the cap 34Y passes through the insertion portion 71, slides along the bottle holder 72 for a certain distance, and then is set in the cap holder 73.

Further, in the present embodiment, four connectors 76 (see FIG. 6) dedicated for the IC chips 35 (see FIGS. 5, 6, and 8) are provided on the cap holder 73 of the toner container frame 70. Specifically, the four connectors 76 communicate with the IC chips 35, serving as electronic data storage devices, attached to end faces 34*f* of the caps 34 of the toner containers 32. The toner containers 32 are aligned so that the IC chips 35 faces the connectors 76, respectively.

The IC chips 35 provided on the toner containers 32Y, 32M, 32C, and 32K exchange data with the respective connectors 76 provided in the image forming apparatus 100. The data exchanged between the toner containers 32 and the image forming apparatus 100 includes, for example, the production serial number of the toner containers 32, the number of times the toner container 32 is reused, the toner storage capacity, the production lot number, the color of the toner, and usage history of the image forming apparatus 100. Other data may also be included. The above-described data may be prestored on the IC chips 35 before they are provided in the image forming apparatus 100. Alternatively, the IC chips 35 may store data transmitted from the image forming apparatus 100 after the toner containers 32 are set in the toner container frame 70 of the image forming apparatus 100.

First Embodiment

Figure 5:
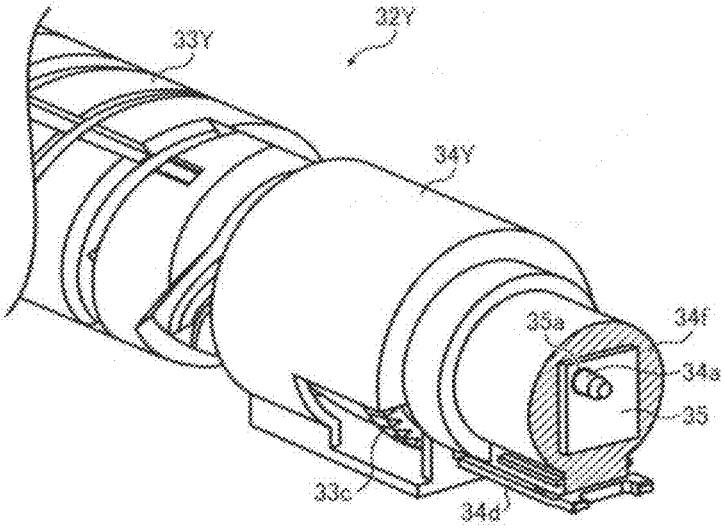
FIG. 5 is a partial, enlarged, perspective view of one end of the toner container shown in FIG. 3.

Next, with reference to FIGS. 5 and 6, specific configuration and operation of the toner container and the image forming apparatus are described below. As illustrated in FIG. 5, the toner container 32Y includes a container body 33Y and a cap 34Y positioned on a top portion of the container body 33Y. The container body (bottle body) 33Y is formed integrally with the gear 33Yc (33*c*) positioned on the top of the container body 33Y. An opening and the gear 33*c* that rotates together with the container body 33Y are provided in one end portion of the container body 33Y in its longitudinal direction. The opening is formed on the head of the container body 33Y that is on a leading side when the toner container 32Y is inserted into the toner container frame 70, and the toner contained in the container body 33Y is discharged through the opening to a space inside the cap 34Y.

The gear 33*c* engages the driving gear 81 provided in the toner container frame 70 of the image forming apparatus 100 to rotate the container body 33Y around a rotary axis (indicated by a broken line in FIG. 3). Referring to FIG. 4, the handle part 33*d* for users is provided on the other end of the container body 33Y (on the downstream or rear side in the installation direction) opposite the side where the gear 33*c* is positioned. The user grasps the handle part 33*d* to insert or remove the toner container 32Y from the image forming apparatus 100. When inserted into the apparatus, the toner container 32Y is moved in the direction indicated by arrow Q shown in FIG. 5. The spiral protrusions 33*b* protruding inward from the inner circumferential face of the container body 33Y is formed in the container body 33Y. In other words, a spiral groove is formed in an outer circumferential surface of the toner container 33Y when viewed from outside. The spiral protrusion 33*b* is for conveying and discharging the toner from the container body 33Y through the opening with rotation of the container body 33Y in a predetermined direction.

The container body 33Y can be produced by injection molding together with elements, such as the gear 33*c* and the handle part 33*d*, provided on the circumferential surface of the container body 33Y.

The cap 34Y is continuous with the container body 33Y. The cap 33Y discharges the toner discharged from the opening to the toner outlet W (move in a direction indicated by broken line in FIG. 3). Herein, a space is formed as a hollow cylinder in the cap 34Y. In addition, a toner discharge path that is formed in a substantially prism shape connects between the hollow cylindrical space to the toner outlet W. In addition, the cap 34Y includes the shutter 34*d*, an IC chip 35 as an electronic data storage device, and a positioning pin (positioning projection) 34*a*. The shutter 34*d* serves as an open-close member to open and close the toner outlet W in conjunction with the installation of the toner container 32Y into the image forming apparatus 100. That is, in conjunction with the installation of the toner container 32Y into the image forming apparatus 100, a stop portion of the image forming apparatus 100 contacts the shutter 34*d*, and the shutter 34*d* is relatively moved and opens the toner outlet W. Conversely, in conjunction with the removal of the toner container 32Y from the image forming apparatus 100, the engagement state between the stop portion and the shutter 34*d* is released, the pressing member presses the shutter 34*d*. Thus, the shutter 34*d* is relatively moved and closes the toner outlet W.

(Feature of Toner Container)

As illustrated in FIG. 5, the positioning projection 34*a* is provided in the cap 34Y. In the present embodiment, the positioning projection is the positioning pin 34*a*, which engages a positioning hole 75*a* that is formed in a positioning portion 75 in the cap holder 73 in the image forming apparatus 100. More specifically, the positioning pin 34*a* projects from the end face (surface) 34*f* of the toner container 32Y, extending in a longitudinal direction of the toner container 32Y (right side in FIG. 3; upstream side in the instillation direction Q). Herein, the end face 34*f* of the toner container 32Y is a downstream surface of the toner container in a direction in which the toner container 32Y is inserted. The positioning pin 34*a* may be formed integrally with the cap 34Y using the same resin material as that of the cap 34Y, or it may be formed of metal material and inserted into the resin cap 34Y.

The positioning portion 75 is provided in an extreme downstream wall (inner wall) 73*w* of the cap holder 73 in the toner container frame 70 in the direction in which the toner container 32Y is inserted into the toner container frame 70. The extreme downstream wall 73*w* of the cap holder 73 faces the end face 34*f* of the cap 34Y in a state in which the toner container 32Y is installed in the toner container frame 70. Then, as the toner container 32Y is installed in the image forming apparatus 100 in FIG. 6, the positioning pin 34*a* engages the positioning hole 75*a*, thereby determining the position of the cap 34Y of the toner container 32Y in the cap holder 73 in the image forming apparatus 100.

In the present embodiment, the positioning pin 34*a* and the positioning hole 75*a* function as main positioning references to determine the position of the cap 34Y of the toner container 32Y relative to the cap holder 73 in the image forming apparatus 100. In addition, figures is omitted, sub-positioning references may be provided in the cap 34Y and the cap holder 73 to assist positioning the cap 34Y of the toner container 32Y relative to the cap holder 73 in the image forming apparatus 100. More specifically, in addition to the main positioning references, as the sub-positioning references, a sub-positioning pin or a sub-positioning hole may be formed on the end face 34*f* of the cap 34Y lower from the positioning pin 34*a*, and corresponding sub-positioning hole or sub-positioning pin may be formed on corresponding portions of the extreme downstream wall 73*w* in the cap holder 73.

In addition, the IC chip 35, serving as the electronic data storage device, is a contact-type IC chip to communicate with the connector 76, serving as a communication portion, in the cap holder 73 in the image forming apparatus 100. The IC chip 35 is disposed on the end face 34*f* of the cap 34Y on which the positioning pin 34*a* is provided. Pads provided on a surface of the IC chip 35 (electronic data storage device) contacts the connecting terminal 76*a* in conjunction with the installation of the toner container 32Y in the toner container frame 70. More specifically, the IC chip 35 is provided on the end face 34*f* perpendicular to the insertion direction of the toner container 32Y into the toner container frame 70 (in a direction indicated by arrow Q in FIG. 6). The IC chip 35 performs contact-communication (wired-communication) to the connector 76 in the image forming apparatus 100 in a state in which the cap 34Y is held in the cap holder 73 of the toner container frame 70.

Herein, the IC chip 35 stores various data relating to the toner container 32Y. By contrast, the connector 76 of the toner container frame 70 sends and receives the data by communicating the IC chip 35 in a state in which the toner container 32Y is installed in the toner container frame 70. That is, the data stored in the IC chip 35 is transmitted to the controller 90 (see FIG. 3) in the image forming apparatus 100 via the connector 76 and the data relating to the image forming apparatus 100 obtained in the controller 90 is transmitted to and stored in the IC chip 35 via the connector 76. More specifically, when the toner container 32Y is installed in the toner container frame 70, the data stored in the IC chip 35 is transmitted to the controller 90 via the connector 76. Thus, the controller 90 properly controls the image forming apparatus 100 based on the transmitted data. "The proper control" is, for example, to stop operation of the toner replenishing device in a case in which the color of the toner in the toner container is different from the color of the toner container to be installed into the toner container frame, or to adjust operating conditions based on serial number, recycle manufacture of the toner container, and so on.

Herein, in the present embodiment, the position of the IC chip 35 (electronic data storage device) is determined relative to the cap 34Y by engaging the IC chip 35 with the positioning pin 34*a*. More specifically, an engaged hole 35*a*, serving as a positioning reference is formed in a substrate of the IC chip 35. The position of the IC chip 35 relative to the cap 34Y is determined by engaging the engaged hole 35*a* in the IC chip 35 with the positioning pin 34*a*. In the present embodiment, the positioning pin 34*a* and the hole 35*a* function as main positioning references to determine position of the IC chip 35 relative to the cap 34Y.

In addition, figures are omitted; sub-positioning references to determine position of the IC chip 35 relative to the cap 34Y may be provided in IC chip 35 and the cap 34Y. More specifically, a sub-positioning pin (projection) may be formed on the end face 34*f* of the cap 34Y to contact a lower surface or side surface of the IC chip 35 may be formed. On the other hand, a sub-positioning hole (e.g., elongate hole) may be formed on the IC chip 35 in a portion lower than the engaged hole 35*a* and corresponding to the sub-positioning pin may be provided on the end face 34*f* of the cap 34Y so that the sub-positioning pin can engage with the sub-positioning hole.

Figure 6:
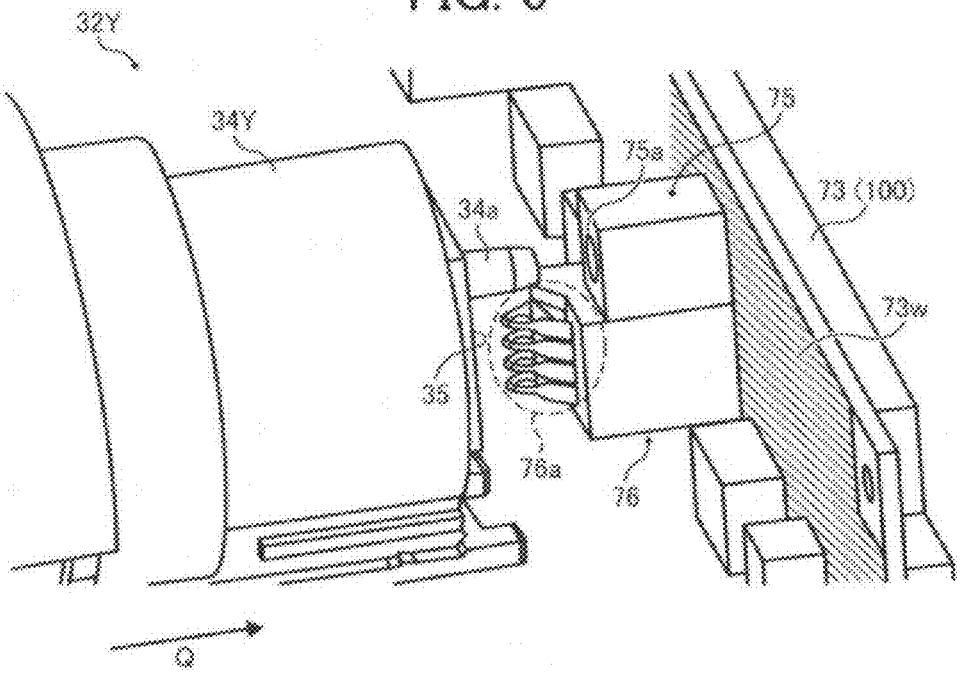
FIG. 6 is an enlarged perspective view illustrating a state of installation of the toner container in the toner container frame shown in FIG. 1.

With reference to FIG. 6, the connector 76 is disposed on the extreme downstream wall 73*w* of the cap holder 73 in the image forming apparatus 100 to face the IC chip 35. That is, the cap holder 73 includes the communication portion (connector) 76 formed in the extreme downstream inner wall 73*w* of the cap holder 73 in the direction in which the toner container 32Y is inserted into the toner container frame 70 and the positioning portion 75 provided in the extreme downstream inner wall 73*w* of the cap holder 73. When the toner container 32Y is installed in a direction indicated by arrow Q in FIG. 6, the positioning pin 34*a* is inserted into the positioning hole 75*a*.

Thus, the position of the cap 34Y relative to the cap holder 73 is determined, and the IC chip 35 comes to be connected to the connecting terminals 76*a* of the connector 76, as a result, the IC chip 35 becomes possible to communicate with the connector 76. At this time, the position of the IC chip 35 relative to the cap 34Y is determined by the positioning pin 34*a* as the positioning reference. The position accuracy of the IC chip 35 relative to the cap holder 73 in the image forming apparatus 100 in a state in which the cap 34Y is installed in the cap holder 73 in the image forming apparatus 100 is improved. Accordingly, the position accuracy of the IC chip 35 relative to the connector 76 in a state in which the toner container 32Y is installed in the image forming apparatus 100 is also improved, therefore, the communication failure caused by connecting failure between the connecting terminals 76*a* of the connector 76 and the IC chip 35 can be restricted.

Figure 7:
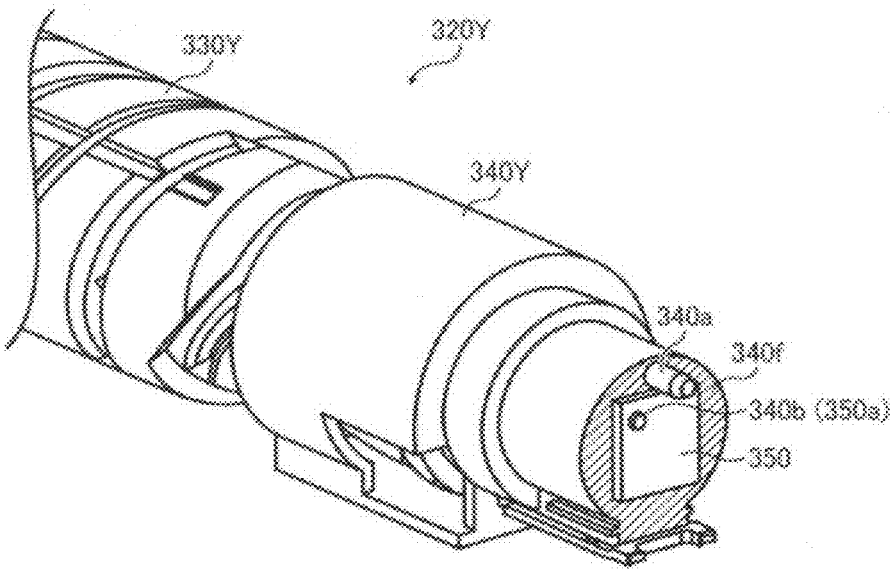
FIG. 7 a perspective view of a toner container according to a comparative example.

FIG. 7 is a schematic perspective view illustrating a toner container 320Y including a container body 330Y according to a comparative example. In the toner container 320Y, position of an IC chip 350 in a cap 340Y is determined independently from a positioning pin (container-positioning pin) 340*a*. In the toner container 320Y shown in FIG. 7, a positioning pin (IC-positioning pin) 340*b* to determine the positions of the IC chip 350 relative to the cap 340Y is provided on an end face 340*f* of the cap 340Y, separately from the positioning pin 340*a* to determine the position of the cap 340Y relative to the image forming apparatus. In this example, by inserting the IC-positioning pin 340*b* for the IC chip 350 into an engaged hole 350*a* formed on a substrate of the IC chip 350, the position of the IC chip 350 relative to the cap 340Y is determined. In such configuration, the position accuracy may be composed by accumulating the various component accuracies, for example, the position accuracy of the two positioning pins 340*a* and 340*b* on the cap 340Y, formation accuracy of the hole 350*a* formed in the IC chip 350. Therefore, finally, the position accuracy of the IC chip 350 relative to a connector in a state in which the toner container 320Y is installed in the image forming apparatus is not so high, and accordingly, the communication failure caused by connecting failure of the IC chip 350 relative to the connecting terminals of the connector may occur.

By contrast, in the present embodiment, the positioning pin to position the cap 34Y relative to the image forming apparatus 100 and the positioning pin to position the IC chip 35 relative to the cap 34Y are used in a common as a single positioning pin 34*a*, the communication failure between the IC chip 35 and the connecting terminals 76*a* of the connector 76 may be effectively prevented.

Herein, the positioning member 75 in the cap holder 73 of the image forming apparatus 100 and the connector 76 may be formed integrally as one unit. That is, it is preferable that the positioning portion 75 having the positioning hole 75*a* be not formed separately from the connector 76 but be formed integrally with the connector 76 in the cap holder 73. Therefore, any decrease in the positioning accuracy between the positioning hole 75*a* and the connector 76 caused by the component accuracy and in assembly accuracy of the positioning portion 75 and the connector 76 in the cap holder 73 can be alleviated. Thus, the communication failure caused by the connecting failure between the connector 76 and the IC chip 35 can be further eliminated and prevented.

As described above, in the image forming apparatus 100 according to the present embodiment, the installation position of the IC chip 35 of the toner container 32Y relative to the image forming apparatus 100 is determined in a state in which the positioning projection 34*a* engages the engaged hole 35*a* in the electronic data storage device 35. Thus, the positioning accuracy of the IC chip 35 relative to the connector 76 (communication portion) of the image forming apparatus 100 can be improved when the toner container 32Y is installed in the image forming apparatus 100. The communication failure between the IC chip 35 of the toner container 32Y and the connector 76 in the image forming apparatus 100 can be reliably alleviated.

It is to be noted that although only single-component developer consisting essentially of only toner is used in the above-described embodiments, the toner container 32Y, 32M, 32C, and 32K can also contain two-component developer including toner and carrier to suitably supply a two-component development device. In this case, the effects described above can be achieved.

Second Embodiment

Figure 8:
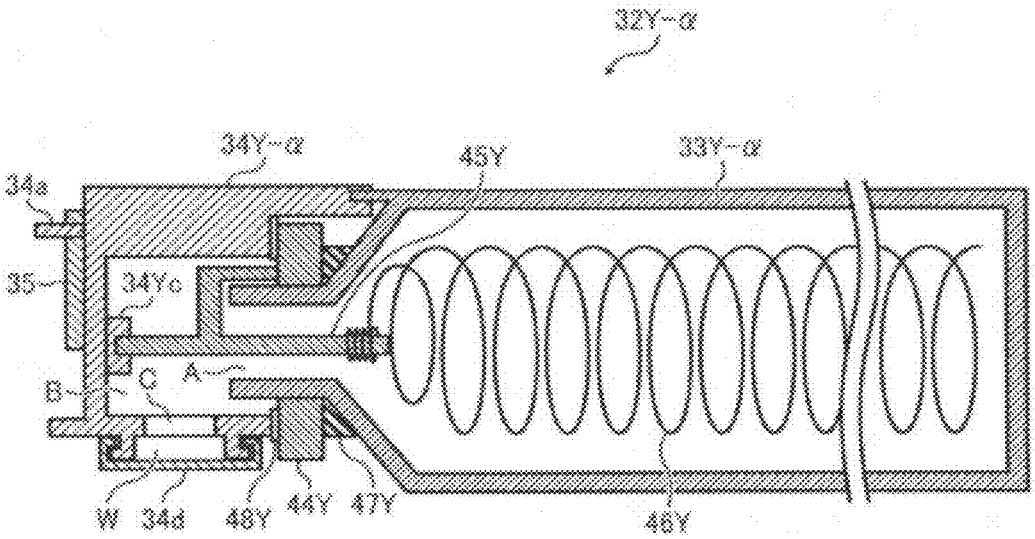
FIG. 8 is a cross-sectional diagram illustrating a toner container according to a second embodiment.

FIG. 8 is a cross-sectional view illustrating a toner container 32Y-α according to a second embodiment. Although the container body 33Y is rotatable relative to the cap 34Y to convey the toner contained in the container body 33Y to the opening in the above-described embodiments, in the present embodiment neither a container body 33Y-α nor a cap 34Y-α are rotatable when the toner container body 32Y-α is installed in the toner container frame 70. Instead, the toner container body 32Y-α includes a conveyance member (45Y, 46Y) to convey the toner contained in the container body 33Y-α to an opening A. For example, the conveyance member is a rotary member to rotate in a predetermined direction and includes a rotary shaft 45Y and a conveyance coil 46Y or multiple conveyance blades.

More specifically, as shown in FIG. 8, the toner container 32Y-α mainly includes the container body 33Y-α, a gear 44Y, and the cap 34Y-α (bottle cap). The opening A is formed on a top of the container body 33Y-α, and the gear 44Y is rotatably attached around the outer surface of the opening A. The gear 44Y engages the driving gear 81 (see FIG. 3) in the image forming apparatus 100 and rotates around the opening A of the container body 33Y-α for rotating the coil 46Y around the rotary shaft 45Y. Further, the toner contained in the container body 33Y-α is discharged from the opening A to space B in the cap 34Y-α. The toner conveyed in the space B in the cap 34Y-α is discharged through a toner outlet C and the toner supply opening 63*w* to the toner tank 61Y of the toner supply device 60Y (see FIG. 3). The gear 44Y and the rotary shaft 45Y together form a single member, and the rotary shaft 45Y is connected to the spiral shaped coil 46Y, which serves as the conveyance member. The one end of the rotary shaft 45Y is supported by a bearing 34Yc of the cap 34Y-α. The coil 46Y extends from the opening A to the backside portion of the (bottom portion) of the container body 33Y-α. With this configuration, as the gear 44Y rotates around the container body 33Y-α, the rotary shaft 45Y and the coil 46Y are rotated.

Thus, the toner contained in the container body 33Y-α is conveyed to the opening A by the conveyance force from the coil 46Y. It is to be noted that the gear 44Y is provided around the outer circumferential surface of the container body 33Y-α so that the gear is sandwiched between the inner face of the cap 34Y-α and the outer surface of the container body 33Y-α. An elastic member 47Y is provided between the gear 44Y and the container body 33Y-α, and a seal member 48Y is formed between the gear 44Y and the cap 34Y-α.

In this configuration, the entire toner container 32Y-α can be sealed reliably. That is, leakage of the toner from the gaps between the gear 44Y and the container body 33Y-α or the gear 44Y and the cap 34Y-α can be prevented. Further, the above-described features of the first embodiment to the fourth embodiment can be adapted in the toner container 32Y-α according to the present embodiment. Accordingly, the similar effect can be achieved.

In addition, in the present embodiments, although the contact-type IC chip 35 is used as the electronic data storage device, non-contact type IC chip or electric substrate may be used as the electronic data storage device. The non-contact type IC may, for example, be a radio frequency identification (RFID) chip. In this case, instead of the connector 76 as the communication portion, a non-contact type antenna or other communicating electronic components can be used as the communication portion.

Further, in the above-described embodiments, although a substantially cylindrical shaped positioning projection is used as the positioning projection, the shape of the positioning projection is not limited thereto. Alternatively, for example, a polygonal projection may be used as the positioning projections, achieving the same effects as described above.

It is to be noted that, in a configuration in which the non-contact type IC chip is used as the electronic data storage device, although the margin of the positioning accuracy is relatively greater than with the use of the contact-type IC, adopting the configuration of the present disclosure becomes useful for positioning therebetween because communication failure may occur when the position of the non-contact type IC chip is greatly deviated relative to the non-contact type communication portion.

In addition, although the bottle shaped container 33Y and the bottle shaped cap 34Y are used as the toner container 32Y, the toner container can adopt other shape of the toner container (for example, box shaped toner container or pouched toner container). These shapes of the toner containers that can be removably installable in the image forming apparatus. In these cases, the positioning projection to determine the position of the toner container relative to the image forming apparatus and the positioning projection to determine the position of the electronic data storage device relative to the toner container are used in common, which can achieve the similar effects described above.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A toner container, removably installable in an image forming apparatus including a communication portion and having a positioning hole, the toner container comprising:

an electronic data storage device, disposed on a surface of the toner container, to communicate with the communication portion in the image forming apparatus, the electronic data storage device having an engaged hole; and a positioning projection, formed in the surface of the toner container, to engage the engaged hole of the electronic data storage device and the positioning hole in the image forming apparatus, wherein the positioning projection of the toner container inserts into the positioning hole in the image forming apparatus in a state in which the positioning projection engages the engaged hole in the electronic data storage device, to determine an installation position of the toner container relative to the image forming apparatus and set the electronic data storage device relative to the communication portion in the image forming apparatus.

2. The toner container according to claim 1, wherein the toner container is removably installable in the image forming apparatus in a state in which a longitudinal direction of the toner container is horizontal, the toner container comprising:

a cylindrical container body, having an opening in one end thereof, to convey toner contained in the container body to the opening; and a cap into which the end of the container body having the opening is inserted, the cap comprising:

a toner outlet to discharge the toner discharged from the opening of the container body vertically downward;

the electronic data storage device disposed on an end face of the cap; and the positioning projection projecting forward from the end face of the cap, extending in the longitudinal direction of the toner container.

3. The toner container according to claim 2, further comprises a continuous inwardly projecting spiral protruding inward from an inner circumferential surface of the container body, wherein the container body is rotatably held by the cap to convey the toner contained in the container body to the opening in one end of the container body.

4. The toner container according to claim 2, further comprising a conveyance member to convey the toner contained in the container body to the opening, contained within the container body and extending in the longitudinal direction of the toner container.

5. The toner container according to claim 1, wherein the electronic data storage device comprises a contact-type IC chip.

6. The toner container according to claim 1, wherein the electronic data storage device comprises a non-contact type IC chip.

7. The toner container according to claim 6, wherein the non-contact type IC is a radio frequency identification (RFID) chip.

8. The toner container according to claim 1, wherein the electric data storage device is positioned except for that portion of the engaged hole.

9. The toner container according to claim 1, wherein the toner container contains carrier in addition to the toner.

10. A toner container frame in which at least one toner container is removably installable, the toner container comprising: an electronic data storage device disposed on a surface of the toner container, the electronic data storage device having an engaged hole; and a positioning projection, formed in the surface of the toner container, to engage the engaged hole in the electronic data storage device, the toner container frame comprising:

a communication portion, formed in an inner wall of the toner container frame, to communicate with the electronic data storage device in the toner container in a state in which the surface of the toner container faces the inner wall of the toner container frame, and a positioning portion provided in the inner wall of the toner container frame, having a positioning hole to engage the positioning projection of the toner container, wherein the positioning projection of the toner container inserts into the positioning hole of the positioning portion in the toner container frame in a state in which the positioning projection engages the engaged hole in the electronic data storage device, to determine an installation position of the toner container relative to an image forming apparatus and set the electronic data storage device relative to the communication portion in the toner container frame.

11. The toner container frame according to claim 10, wherein the communication portion and the positioning portion are formed integrally as one unit.

12. The toner container frame according to claim 10, wherein the toner container is removably installable in the image forming apparatus in a state in which a longitudinal direction of the toner container is horizontal, wherein the toner container comprises a cylindrical container body, having an opening in one end thereof, to convey toner contained in the container body to the opening and a cap into which the end of the container body having the opening is inserted, and the cap comprises a toner outlet to discharge the toner discharged from the opening of the container body vertically downward, the electronic data storage device disposed on a downstream surface of the cap in a direction in which the toner container is inserted into the toner container frame, and the positioning projection projecting forward from the downstream surface of the cap, extending in the longitudinal direction of the toner container, the toner container frame comprising:

an insertion portion having an inserting opening through which the toner container is inserted into the toner container frame;

a container holder to hold the container body of the toner container; and a cap holder to hold the cap of the toner container, provided in a downstream portion of the toner container frame in a direction in which the toner container is inserted into the toner container frame;

the cap holder comprising:

the communication portion, formed in an extreme downstream inner wall of the cap holder in the direction in which the toner container is inserted into the toner container frame; and the positioning portion, provided in the extreme downstream inner wall of the cap holder.

13. An image forming apparatus comprising:

a toner container frame, provided in a main body of the image forming apparatus; and at least one toner container, removably installable in the toner container frame, the toner container comprising:

an electronic data storage device disposed on a surface of the toner container, the electronic data storage device having an engaged hole; and a positioning projection, formed in the surface of the toner container, to engage the engaged hole in the electronic data storage device, the toner container frame comprising:

a communication portion, formed in an inner wall of the toner container frame, to communicate with the electronic data storage device in the toner container in a state in which the surface of the toner container faces the inner wall of the toner container frame, and a positioning portion provided in the inner wall of the toner container frame, having a positioning hole to engage the positioning projection of the toner container, wherein the positioning projection of the toner container inserts into the positioning hole of the positioning portion in the toner container frame in a state in which the positioning projection engages the engaged hole in the electronic data storage device, to determine an installation position of the toner container relative to the image forming apparatus and set the electronic data storage device relative to the communication portion in the toner container frame.

14. The image forming apparatus according to claim 13, wherein the communication portion and the positioning portion are formed integrally as one unit.

15. The image forming apparatus according to claim 13, wherein the toner container is removably installable in the image forming apparatus in a state in which a longitudinal side of the toner container is horizontal, the toner container comprising:

a cylindrical container body, having an opening in one end thereof, to convey toner contained in the container body to the opening; and a cap into which the end of the container body having the opening is inserted, the cap comprising:

a toner outlet to discharge the toner discharged from the opening of the container body vertically downward;

the electronic data storage device disposed on a downstream surface of the cap in a direction in which the toner container is inserted into the toner container frame; and the positioning projection, projecting forward from the downstream surface of the cap, extending in the longitudinal direction of the toner container, the toner container frame comprising:

an insertion portion having an inserting opening through which the toner container is inserted into the toner container frame;

a container holder to hold the container body of the toner container;

a cap holder to hold the cap of the toner container, provided in a downstream portion of the toner container frame in a direction in which the toner container is inserted into the toner container frame;

the cap holder comprising:

the communication portion, formed in an extreme downstream inner wall of the cap holder in the direction in which the toner container is inserted into the toner container frame; and the positioning portion, provided in the extreme downstream inner wall of the cap holder.

* * * * *